US008247145B2

(12) United States Patent
Kusaka et al.

(10) Patent No.: US 8,247,145 B2
(45) Date of Patent: Aug. 21, 2012

(54) MAGENTA TONER FOR DEVELOPING ELECTROSTATIC IMAGE

(75) Inventors: Natsuko Kusaka, Tokyo (JP); Mikio Kouyama, Kunitachi (JP); Kenji Hayashi, Hachioji (JP); Hiroaki Obata, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 784 days.

(21) Appl. No.: 12/188,583

(22) Filed: Aug. 8, 2008

(65) Prior Publication Data

US 2009/0068581 A1 Mar. 12, 2009

(30) Foreign Application Priority Data

Sep. 7, 2007 (JP) ..... 2007-232398

(51) Int. Cl.
*G03G 9/09* (2006.01)

(52) U.S. Cl. ..... 430/108.21; 430/108.11; 430/108.2; 430/108.23

(58) Field of Classification Search ..... 430/107.1, 430/108.2, 108.11, 108.21, 108.23
See application file for complete search history.

(56) References Cited

U.S. PATENT DOCUMENTS

| | | | | |
|---|---|---|---|---|
| 5,166,030 | A * | 11/1992 | Ono et al. | 430/108.11 |
| 6,455,215 | B1 * | 9/2002 | Hashimoto et al. | 430/108.23 |
| 2003/0207186 | A1 * | 11/2003 | Itakura et al. | 430/45 |
| 2005/0011410 | A1 * | 1/2005 | Banning et al. | 106/493 |
| 2005/0011411 | A1 * | 1/2005 | Banning et al. | 106/493 |
| 2005/0016417 | A1 * | 1/2005 | Wu et al. | 106/31.29 |
| 2005/0106481 | A1 * | 5/2005 | Ayaki et al. | 430/45 |

FOREIGN PATENT DOCUMENTS

JP 07325427 A * 12/1995

* cited by examiner

*Primary Examiner* — Christopher Rodee
*Assistant Examiner* — Jonathan Jelsma
(74) *Attorney, Agent, or Firm* — Squire Sanders (US) LLP

(57) ABSTRACT

A magenta toner for developing an electrostatic image, the magenta toner comprising at least a binder resin and a magenta colorant, wherein the magenta colorant comprises a compound represented by Formula (1), wherein D is represented by one of Formulas (2) to (4):

Formula (1)

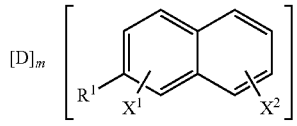

Formula (2)

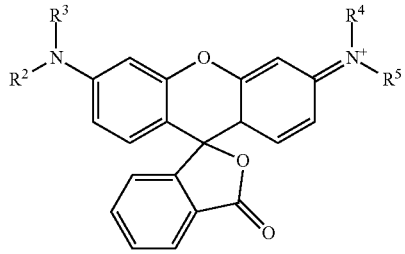

Formula (3)

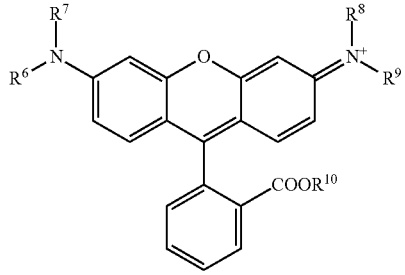

Formula (4)

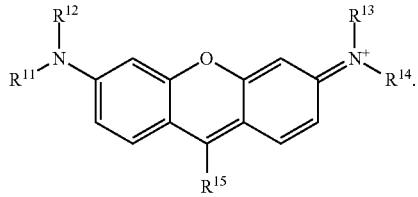

15 Claims, No Drawings

MAGENTA TONER FOR DEVELOPING ELECTROSTATIC IMAGE

TECHNICAL FIELD

The present invention relates to a magenta toner for developing an electrostatic image employed in a color image forming method via electrophotography.

BACKGROUND

Over recent years, high quality printed images have been greatly demanded, even for copiers and printers employing electrophotography, specifically for the copiers and the printers for color images.

To obtain high quality images, it is known to be effective to decrease the particle diameter of a toner. In order to realize this, a variety of so-called chemical toners have been proposed. However, it has been difficult to say that such toners could realize sufficient color reproduction. The reason is that, since copiers and printers employing electrophotography have become widespread mainly in common office and for official document applications, light stability has been emphasized in toners from the viewpoint of obtaining long-term stability of printed images, whereby toners employing organic pigments as colorants have been commonly produced.

Namely, organic pigments are usually superior in heat resistance and light stability compared to those of dyes. However, organic pigments exhibit a lower chroma. Accordingly, toners employing organic pigments tend to exhibit a narrower color gamut (color reproduction range).

Further, in a color image formed via a subtractive color mixing method in which coloration is carried out with the reflected light of the three primary colors of yellow, magenta, and cyan, the color gamut thereof is narrow as compared to a color image observed on a display panel formed with an additive color mixing method. Thereby, there has been noted the problem that color data edited on a display panel could not be precisely reproduced on a printed material.

Assuming that it is effective to use a magenta toner exhibiting a high chroma is effective to solve this problem, use of a magenta toner exhibiting a high chroma has been proposed (for example, refer to patent Document 1).

However, even with such a magenta toner, reproduction of magenta or blue equivalent to those observed on a display panel has not been enough. The reason is that magenta is inherently a complementary color of green and the reflectance spectrum of magenta ideally has a hue angle having a good balance between a blue component and a red component, but the above magenta toner has an insufficient blue component, resulting in exhibiting a poor balance.

Further, since the magenta colorants used for such a magenta toner exhibit poor pulverization properties, it is difficult to obtain a particle diameter not more than a prescribed value, even using a wet-type pulverizer, whereby a magenta colorant in magenta toner particles has poor dispersibility. Accordingly, the magenta colorant tends to be unevenly distributed on the surface of the magenta toner particles, whereby weakly charged toner particles with an insufficient charging amount or excessively charged toner particles, which are excessively charged, are formed. Therefore, the weakly charged toner particles exhibit poor adhesion to a frictional charge-providing member such as carriers or a development roll, resulting in a tendency to cause 'toner scattering' (also referred to as 'toner cloud' or "flying toner"). In contrast, the excessively charged toner particles exhibit excessively strong adhesion to the frictional charge-providing member, therefore, the toner particles remain in the system without leaving, whereby frictional charging to be conducted by a freshly fed toner and the frictional charge-providing member may be prevented. Accordingly, the freshly fed toner scatters in the machine without being charged. As the result, in cases of long-term use, the optical sensors in the machine become contaminated due to toner scattering, resulting in the possibility of causing malfunctions or shutdown of the apparatus.

Patent Document 1: Japanese Patent Application Publication Open to Public Inspection (hereafter referred to as JP-A) No. 5-11504

SUMMARY OF THE INVENTION

An object of the present invention is to provide a magenta toner for developing an electrostatic image, which exhibits high chroma, an adequate hue angle and excellent charge stability, and enables forming a high quality image free from toner blister while enabling high color reproducibility in a wide color gamut.

One of the aspects to achieve the above object of the present invention is a magenta toner for developing an electrostatic image, the magenta toner containing at least a binder resin and a magenta colorant, wherein the magenta colorant comprises a compound represented by Formula (1) which includes, for example, a rhodamine-naphthyl sulfonate:

Formula (1)

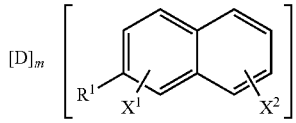

wherein D is represented by one of Formulas (2) to (4); $R^1$ represents a hydrogen atom or an alkyl group having 1 to 22 carbon atoms; and $X^1$ and $X^2$ each independently represent a hydrogen atom, an alkyl group or $—SO_3^-$, provided that at least one of $X^1$ and $X^2$ is $—SO_3^-$ and m is an integer representing a number of $—SO_3^-$:

Formula (2)

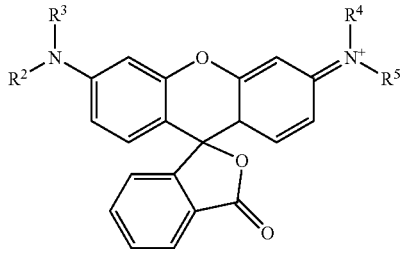

Formula (3)

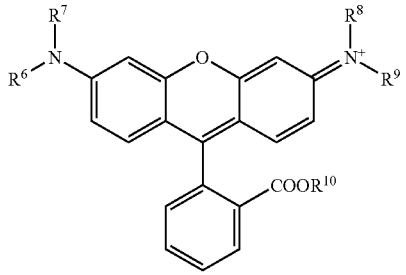

-continued

Formula (4)

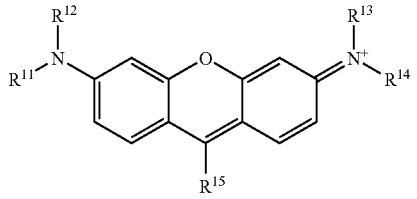

wherein $R^2$ to $R^{15}$ each represent a hydrogen atom or an alkyl group having 1 to 22 carbon atoms.

Another aspects of the present invention is a magenta toner for developing an electrostatic image, the magenta toner containing at least a binder resin and a magenta colorant, wherein the magenta colorant comprises a compound represented by Formula (1) and at least one of a compound represented by Formula (5) (quinacridone compound) and a compound represented by Formula (6) (naphthol compound); and a ratio of mA:mB is preferably in the range of 90:10 to 55:45, wherein mA represents a mass content of the compound represented by Formula (1); and mB represents a mass content of the at least one of the compound represented by Formula (5) and the compound represented by Formula (6):

Formula (5)

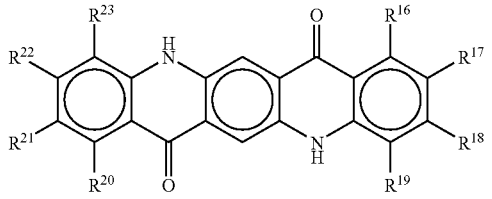

wherein $R^{16}$ to $R^{23}$ each represent a hydrogen atom, a chlorine atom or a methyl group, Formula (6)

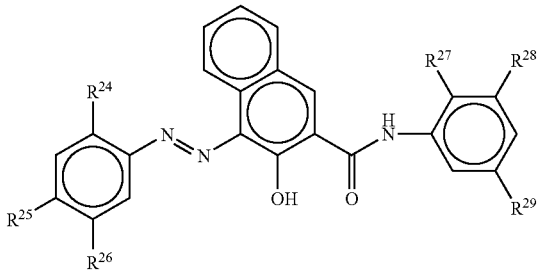

wherein $R^{24}$, $R^{25}$, $R^{24}$, $R^{28}$ and $R^{29}$ each represent a hydrogen atom, a chlorine atom, a methoxy group, a nitro group, a methyl group or —$CONH_2$; and $R^{26}$ represents a hydrogen atom, a chlorine atom, a methoxy group, a nitro group, a methyl group, —$CONHC_6H_5$ or —$SO_2N(CH_2CH_3)_2CONH_2$.

DESCRIPTION OF THE PREFERRED EMBODIMENTS

According to the magenta toner for developing an electrostatic image of the present invention, a magenta colorant contains a compound represented by Formula (1) (such as naphthyl sulfonate of rhodamine). Since this compound has a property of emitting fluorescence, the color gamut of the image formed by using the magenta toner becomes nearly as wide as that observed on a display panel in which color production is conducted via an additive color mixing method. Accordingly, it is possible to allow a printed color image to have a color close to that observed on a display panel. Further, since vivid coloration is carried out using the compound represented by Formula (1), a high chroma can be realized, whereby high color reproducibility can be achieved.

Further, the magenta colorant has a charge controlling function on its own and also exhibits excellent pulverizability. Therefore, the magenta colorant can be minutely dispersed in toner particles, resulting in obtaining sharp distribution of charging amount and excellent charge stability. Accordingly, the occurrence of toner scattering (toner cloud) is prevented even when the humidity varies, and then even in cases of long-term use, contamination of the optical sensors in the machine due to toner scattering is prevented, resulting in only limited possibility of causing malfunctions or shutdown of the apparatus.

Still further, a magenta toner for developing an electrostatic image containing a magenta colorant composed of a compound having at least one sulfo group tends not to form a hardly soluble salt with a multivalent metal element, on the contrary to a magenta toner for developing an electrostatic image containing a magenta colorant composed of a diphenylethersulfonate of rhodamine. Therefore, since no hydration of the hardly soluble salt occurs, the water content of the toner is controlled to be low, resulting in preventing pinhole-like image defects, namely the occurrence of so-called toner blister generated via water vapor ejection during fixing.

The present invention will now be specifically described.

The magenta toner for developing an electrostatic image of the present invention (hereinafter referred to simply as the "magenta toner") is composed of magenta toner particles containing at least a binder resin and a magenta colorant. The magenta colorant contains a compound represented by above Formula (1).

<Magenta Colorant>

In Formula (1), $R^1$ is a hydrogen atom or an alkyl group having 1-22 carbons, but $R^1$ is preferably an alkyl group having 6-18 carbons from the viewpoint that the magenta colorant exhibits excellent dispersibility in a toner particle.

Further, in Formula (1), $X_1$ and $X^2$ each are a hydrogen atom, an alkyl group, or —$SO_3^-$ (sulfo group), and at least one of $X^1$ and $X^2$ is —$SO_3^-$. From the viewpoint of preventing toner scattering phenomena, it is preferable that one of $X^1$ and $X^2$ is —$SO_3^-$ and the other is a hydrogen atom.

The positional relationship, on the naphthyl group, between —$SO_3^-$ representing at least one of the group $X^1$ and the group $X^2$ and an alkyl group representing the group $R^1$ is not specifically limited.

Further, in Formula (1), m is an integer the same as the number of —$SO_3^-$. Specifically, when both of $X^1$ and $X^2$ are —$SO_3^-$ simultaneously, m is 2, and when one of $X^1$ or $X^2$ is —$SO_3^-$, m is 1.

Still further, in Formula (1), D is an ammonium ion represented by any one of Formulas (2)-(4). From the viewpoint of preventing toner scattering, D is preferably a rhodamine-based quaternary ammonium ion, containing a lactone ring, represented by Formula (2).

In Formulas (2)-(4), $R^2$-$R^{15}$ each represent a hydrogen atom, an alkyl group having 1-22 carbons, or a cycloalkyl group.

Herein, $R^2$-$R^{15}$ each are preferably an ethyl group, a propyl group, a t-butyl group, or a cyclohexyl group.

The specific examples of a compound represented by Formula (1) include the compounds represented by following Compounds (1-1)-(1-8):

Compound (1-1)

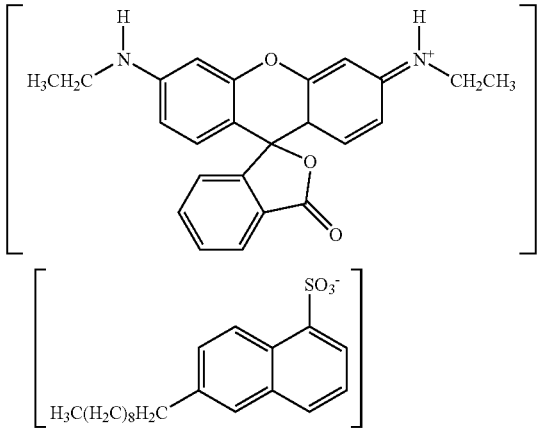

Compound (1-2)

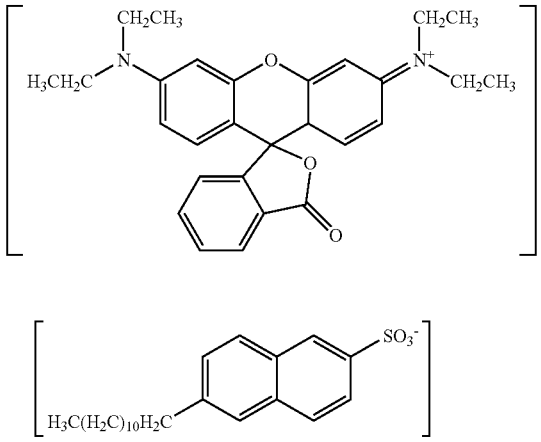

Compound (1-3)

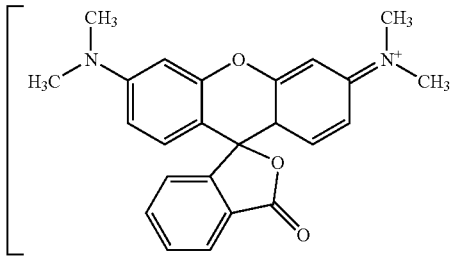

-continued

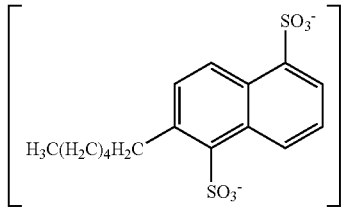

Compound (1-4)

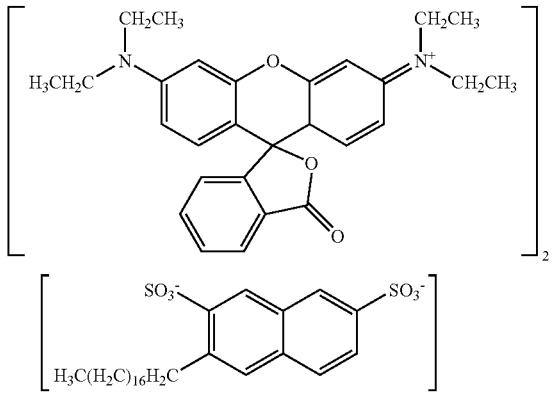

Compound (1-5)

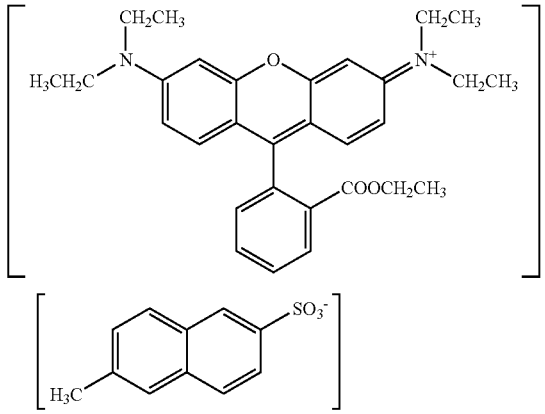

Compound (1-6)

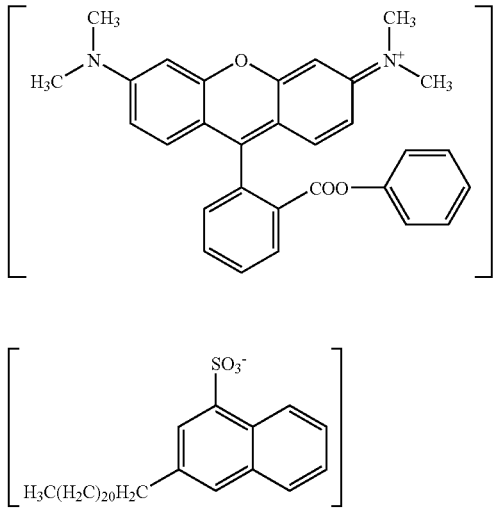

-continued

Compound (1-7)

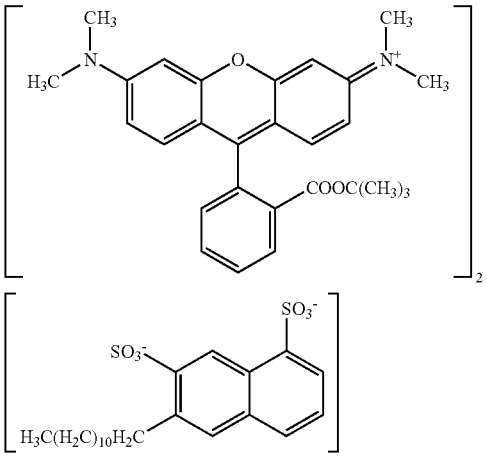

Compound (1-8)

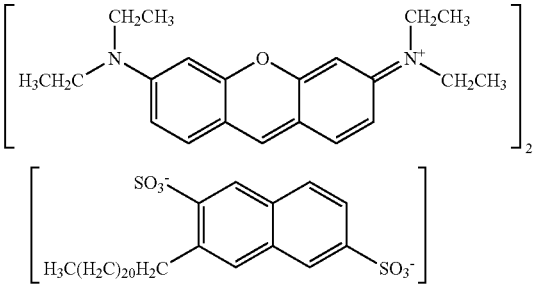

From the viewpoint of preventing toner scattering, as the compound represented by Formula (1) constituting a magenta colorant, preferable are those represented by Compounds (1-1)-(1-4), but specifically preferable are those represented by Compound (1-1) and Compound (1-2).

The compound represented by Formula (1) described above can be used individually or in combination of at least 2 types, as appropriate.

For a magenta colorant used for the magenta toner of the present invention, only such the compound represented by Formula (1) may be used. However, to realize light stability and sufficient color reproduction of a dark tone, there may also be used a mixture of a compound represented by Formula (1) and at least one of the compound represented by Formula (5) and the compound represented by Formula (6). Also, in order to obtain sufficient charge stability and to prevent an image defect so called toner blister, it is preferable to use a compound represented by Formula (1) together with at least one of a compound represented by Formula (5) and a compound represented by Formula (6).

When the magenta colorant contains a mixture of a compound represented by Formula (1) and at least one of a compound represented by Formula (5) and a compound represented by Formula (6), the ratio of mA:mB is preferably 90:10-55:45, provided that mA represents a mass content of the compound represented by Formula (1) and mB represents a mass content of the at least one of a compound represented by Formula (5) and a compound represented by Formula (6).

In above Formula (5), $R^{16}$-$R^{23}$ each are a hydrogen atom, a chlorine atom, or a methyl group.

Of the compounds represented by Formula (5), the compound represented by following Compound (5-1) is specifically preferable.

Compound (5-1)

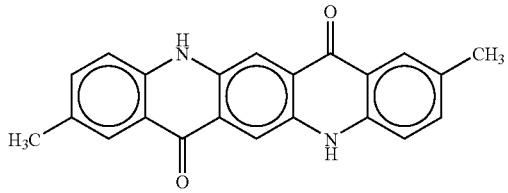

Further, in above Formula (6), $R^{24}$, $R^{25}$, $R^{27}$, $R^{28}$, and $R^{29}$ each are a hydrogen atom, a chlorine atom, a methoxy group, a nitro group, or —$CONH_2$, and $R^{26}$ is a hydrogen atom, a chlorine atom, a methoxy group, a nitro group, a methyl group, —$CONHC_6H_5$, or —$SO_2N(CH_2CH_3)_2CONH_2$.

Specific examples of a compound represented by Formula (6) include those represented by following Compounds (6-1)-(6-6):

Compound (6-1)

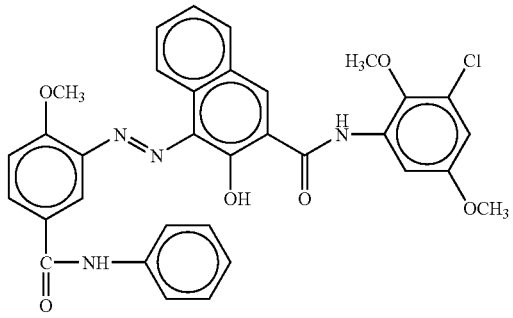

Compound (6-2)

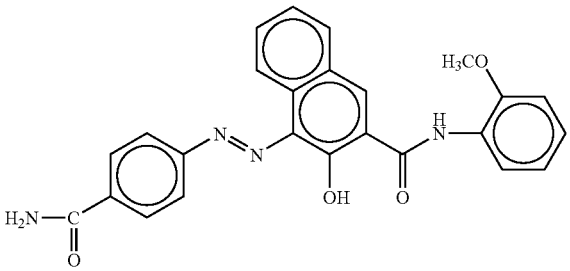

Compound (6-3)

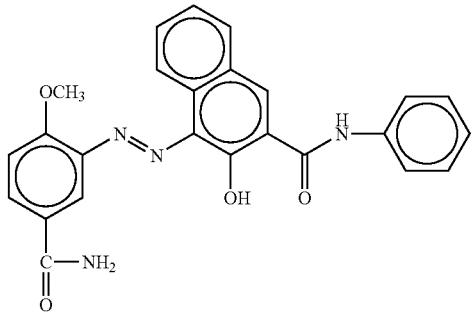

-continued

Compound (6-4)

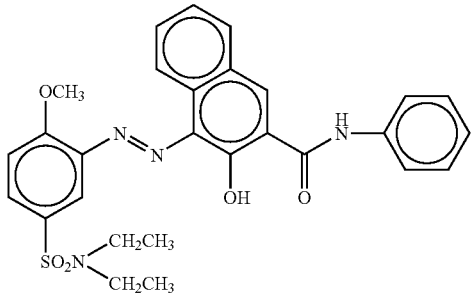

Compound (6-5)

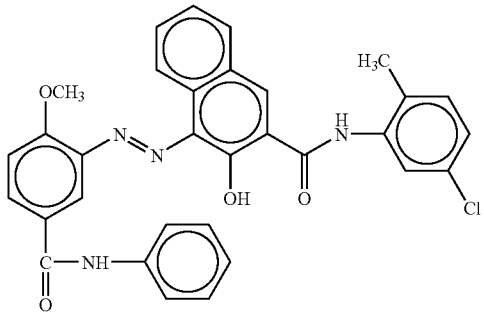

Compound (6-6)

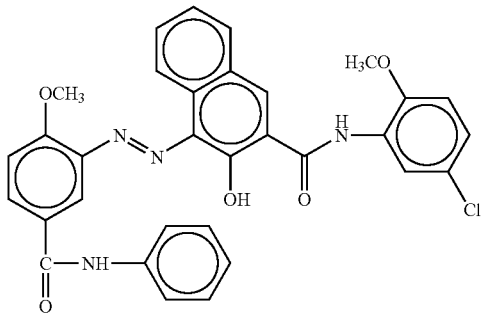

Of the above compounds, the compound represented by Compound (6-6) is specifically preferable.

The compound represented by Formula (5) and the compound represented by Formula (6) can be used individually or in combination of at least 2 types, as appropriate. Further, any appropriate compound represented by Formula (5) and compound represented by Formula (6) can also be used simultaneously.

Further, for a magenta colorant of the magenta toner of the present invention, a mixture of a compound represented by Formula (1) and a non-rhodamine compound, represented by Compound (A) or Compound (B) described below, can also be used.

When the magenta colorant contains a mixture of a compound represented by Formula (1) and such a non-rhodamine compound, the mixture ratio of the compound represented by Formula (1) to the non-rhodamine compound is preferably 90:10-55:45 in mass ratio.

Compound (A)

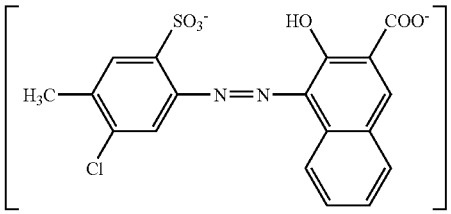

Compound (B)

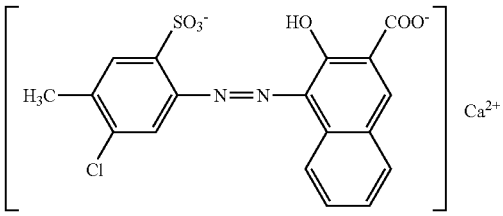

The content of a magenta colorant is 2-15% by mass, preferably 4-10% by mass based on the total mass of magenta toner particles even when any of those represented by Compounds (A) and (B) is contained.

The magenta toner according to the present invention refers to a toner having a hue angle in the range of 320-360° when a visible image formed on plain paper having a basis weight of 128 g/m$^2$ and lightness of 93 with a toner deposited amount of 0.5 mg/cm$^2$ is represented by the L*a*b* calorimetric system, provided that the lightness is L*; the hue in the red-green direction is a*; and the hue in the yellow-blue direction is b*. As a plain paper (a transfer paper), for example, POD gloss coated paper produced by Nippon Paper Industries Co., Ltd. can be cited.

Herein, the L*a*b* calorimetric system is a method preferably used to quantify a color. Both a* axis and b* axis represent the hue and chrome. The lightness refers to the relative lightness of a color, and the hue refers to color such as red, yellow, green, blue, or purple. The chroma refers to the degree of color vividness.

And the hue angle refers to an angle of a half line between a given coordinate point (a, b) and the original pint O measured in the counterclockwise direction from the + direction of the a* axis (the red direction) in an a* axis-b* axis coordinate plane.

<Binder Resin>

Any appropriate binder resins can be used with no specific limitation.

Specific examples of such binder resins include, for example, a styrene resin, an acryl resin such as an alkylacrylates or an alkylmethacrylate, a vinyl polymer such as a styrene-acryl copolymeric resin, an olefin resin, a polyester resin, a silicone resin, an amide resin and an epoxy resin. In particular, in order to enhance transparency and the color reproducibility of a superimposed image, a styrene resin and an acryl resin, which exhibit high transparency, as well as low viscosity of the melt and sharp-melt properties, are preferably used. These can be used individually or in combination of at least 2 types.

Further, as polymerizable monomers to obtain these binder resins, there can be used, for example, styrene monomers such as styrene, methylstyrene, methoxystyrene, butylstyrene, phenylstyrene, or chlorostyrene; (meth)acrylate monomers such as methyl acrylate, ethyl acrylate, butyl acrylate, ethylhexyl acrylate, methyl methacrylate, ethyl methacrylate, butyl methacrylate, or ethylhexyl methacrylate; and carboxylic acid-based monomers such as acrylic acid or fumaric acid. These can be used individually or in combination of at least 2 types.

As such binder resins, preferably used are the resins having a number average molecular weight (Mn) of 3,000-20,000, preferably 3,500-15,000; a ratio Mw/Mn of the weight average molecular weight (Mw) to the number average molecular weight (Mn) of 2-6, preferably 2.5-5.5; a glass transition temperature (Tg) of 10-70° C., preferably 25-40° C.; and a softening temperature of 70-110° C., preferably 80-105° C.

<Production Method of Magenta Toner>

A production method of the magenta toner of the present invention is one in which particles composed of a binder resin (hereinafter referred to as "binder resin particles") and colorant particles containing a magenta colorant are aggregated and fused. Specifically, for example, an emulsion polymerization aggregation method is cited.

The emulsion polymerization aggregation method is a production method of toner particles in which a dispersion of binder resin particles, having been produced via an emulsion polymerization method, is mixed with a dispersion of other toner particle constituents such as colorant particles, and then slowly aggregated while maintaining a balance between the repulsive force of the particle surface which is controlled by pH adjustment and the aggregation force which is controlled by addition of a coagulant composed of an electrolyte; and the resulting product is associated while controlling the average particle diameter and the particle size distribution, and simultaneously fusion among the particles is carried out via heat-stirring for shape controlling.

Such a binder resin particle may be structured of at least 2 layers composed of binder resins having different compositions. In this case, there can be employed a method in which, in a dispersion of a first resin particle having been prepared via an emulsion polymerization treatment (first-step polymerization) based on a common method, a polymerization initiator and a polymerizable monomer are added and then the resulting system is subjected to another polymerization treatment (second-step polymerization).

One example of production processes to obtain the magenta toner of the present invention via the emulsion polymerization aggregation method will now specifically be described:

(1) Colorant particle dispersion preparation process to obtain a dispersion of colorant particles in which colorant particles containing a magenta colorant are dispersed in an aqueous medium;

(2) Binder resin particle polymerization process to obtain binder resin particles, in which a polymerizable monomer solution is prepared by dissolving or dispersing toner particle constituent materials such as a releasing agent and a charge controller, if necessary, in a polymerizable monomer to form a binder resin, and the resulting solution is added in an aqueous medium to form oil droplets by applying mechanical energy, followed by conducting a polymerization reaction in the oil droplets, which is initiated by the radicals generated from a water-soluble radical polymerization initiator;

(3) Salting-out/aggregation/fusion process to form magenta toner particles, in which salting-out is conducted along with aggregation/fusion by adding a coagulant in an aqueous medium in which binder resin particles and colorant particles are dispersed, and by adjusting the temperature;

(4) Filtration/washing process to filter magenta toner particles from an aqueous medium and to remove substances such as a surfactant from the magenta toner particles;

(5) Drying process to dry magenta toner particles having been subjected to washing; and (6) Process to add an external additive to magenta toner particles having been subjected to drying.

Herein, the "aqueous medium" refers to a medium composed of 50-100% by mass of water and 0-50% by mass of a water-soluble organic solvent. As the water-soluble organic solvent, there can be exemplified methanol, ethanol, isopropanol, butanol, acetone, methyl ethyl ketone, and tetrahydrofuran. Alcohol-based organic solvent not dissolving any obtained resins are preferable.

In the colorant particle formation process, a dispersion of colorant particles, in which colorant particles are dispersed in an aqueous medium via mechanical energy, is prepared. Homogenizers to conduct oil droplet dispersion via mechanical energy are not specifically limited. Examples of a homogenizer include: "CLEAR MIX" (produced by M Technique Co., Ltd.) which is a homogenizer equipped with a high-speed rotating rotor, an ultrasonic homogenizer, a mechanical homogenizer, Manton-Gaulin homogenizer and a pressure-type homogenizer.

With regard to colorant particles in a dispersion prepared in this colorant particle formation process, the volume median diameter thereof is preferably in the range of 10-300 nm, more preferably 100-200 nm and specifically preferably 100-150 nm.

The volume median diameter of colorant particles is controlled within 10-500 nm, for example, by adjusting the magnitude of the mechanical energy of the above homogenizer.

Further, with regard to binder resin particles in a dispersion prepared in the binder resin particle polymerization process, the volume median diameter thereof is preferably in the range of 50-200 nm.

[Chain Transfer Agent]

When magenta toner particles constituting the magenta toner of the present invention are produced via an emulsion polymerization aggregation method, any commonly used chain transfer agent can be employed to control the molecular weight of a binder resin. The chain transfer agent is not specifically limited, of which examples include: 2-chloroethanol; mercaptans such as octyl mercaptan, dodecyl mercaptan and t-dodecyl mercaptan; and styrene diners.

[Polymerization Initiator]

When magenta toner particles constituting the magenta toner of the present invention are produced via an emulsion polymerization aggregation method, as a polymerization initiator to obtain a binder resin, any appropriate one can be used if being a water-soluble polymerization initiator. Specific examples of the polymerization initiator include: persulfates (such as potassium persulfate or ammonium persulfate), azo compounds (such as 4,4'-azobis4-cyano valerate and salts thereof, or 2,2'-azobis(2-amidinopropane)salt), and peroxide compounds.

[Surfactant]

As a surfactant to be used when magenta toner particles constituting the magenta toner of the present invention are produced via an emulsion polymerization aggregation method, various anionic surfactants, cationic surfactants, and nonionic surfactants conventionally known in the art can be used.

The anionic surfactants include, for example, higher fatty acid salts such as sodium oleate; alkylarylsulfonic acid salts such as sodium dodecylbenzenesulfonate; alkylsulfuric acid ester salts such as sodium laurylsulfate; polyoxyethylene alkyl ether sulfuric acid ester salts such as polyethoxyethylene lauryl ether sodium sulfate; polyoxyethylene alkyl aryl ether sulfuric acid ester salts such as polyoxyethylene nonyl phenyl ether sodium sulfate; alkylsulfosuccinic acid ester salts such as sodium monooctylsulfosuccinate, sodium dioctylsulfosuccinate, or polyoxyethylene sodium laurylsulfosuccinate; and derivatives thereof.

Further, the cationic surfactants include, for example, aliphatic amine salts, aliphatic quaternary ammonium salts, benzalkonium salts, benzethonium chloride, pyridinium salts, and imidazolinium salts.

Still further, the nonionic surfactants include, for example, polyoxyethylene alkyl ethers such as polyoxyethylene lauryl ether or polyoxyethylene stearyl ether; polyoxyethylene alkyl phenyl ethers such as polyoxyethylene nonyl phenyl ether; sorbitan higher fatty acid esters such as sorbitan monolaurate, sorbitan monostearate, or sorbitan trioleate; polyoxyethylene sorbitan higher fatty acid esters such as polyoxyethylene sorbitan monolaurate; polyoxyethylene higher fatty acid esters such as polyoxyethylene monolaurate or polyoxyethylene monostearate; glycerin higher fatty acid esters such as oleic acid monoglyceride or stearic acid monoglyceride; and polyoxyethylene-polyoxypropylene-block copolymers.

[Coagulant]

A coagulant to be used when magenta toner particles constituting the magenta toner of the present invention are produced via an emulsion polymerization aggregation method includes, for example, alkali metal salts and alkaline earth metal salts. The alkali metal constituting the coagulant includes lithium, potassium, and sodium. The alkaline earth metal constituting the coagulant includes magnesium, calcium, strontium, and barium. Of these, potassium, sodium, magnesium, calcium, and barium are preferable. A counter ion (namely an anion constituting a salt) of the alkali metal or alkaline earth metal includes chloride ion, bromide ion, iodide ion, carbonate ion, and sulfate ion.

[Releasing Agent]

An appropriate releasing agent, contributing to prevent offset phenomena, may be incorporated in magenta toner particles constituting the magenta toner of the present invention. Herein, the releasing agent is not specifically limited, including, for example, polyethylene wax, oxidized-form polyethylene wax, polypropylene wax, oxidized-form polypropylene wax, carnauba wax, Sasol wax, rice wax, candelilla wax, jojoba wax, and bees wax.

A method of incorporating a releasing agent into magenta toner particles includes a method wherein, in the salting-out/aggregation/fusion process to form magenta toner particles, a dispersion of releasing agent particles (a wax emulsion) is added to allow binder resin particles, colorant particles, and releasing agent particles to undergo salting-out, aggregation, and fusion; and a method wherein, in the salting-out/aggregation/fusion process to form magenta toner particles, binder resin particles and colorant particles containing a releasing agent are allowed to undergo salting-out, aggregation, and fusion. These methods may be employed in combination.

The content ratio of a releasing agent in magenta toner particles is commonly 0.5-5 parts by mass, preferably 1-3 parts by mass based on 100 parts by mass of a binder resin. When the content ratio of the releasing agent is less than 0.5 part by mass based on 100 parts by mass of the binder resin, the offset preventing effect becomes insufficient. In contrast, in cases of more than 5 parts by mass based on 100 parts by mass of the binder resin, a magenta toner obtained tends to exhibit poor translucency and poor color reproducibility.

[Charge Controller]

Any appropriate charge controller may be added in magenta toner particles constituting the magenta toner of the present invention. The charge controller is not specifically limited, and there can be listed various substances providing positive or negative charges via frictional charging. For example, as a negatively chargeable charge controller used for magenta toner particles, colorless, white, or light-colored charge controllers are listed so as not to adversely affect the hue or transparency of the magenta toner. Such charge controllers preferably include, for example, metal complexes of salicylic acid derivatives with zinc or chromium (salicylic acid metal complexes), calixarene compounds, organic boron compounds, and fluorine-containing quaternary ammonium salt compounds. Specifically, the salicylic acid metal complexes include, for example, those disclosed in JP-A Nos. 53-127726 and 62-145255, and the calixarene compounds include, for example, those disclosed in JP-A No. 2-201378. The organic boron compounds include, for example, those disclosed in JP-A No. 2-221967, and the fluorine-containing quaternary ammonium salt compounds include, for example, those disclosed in JP-A No. 3-1162.

The content ratio of a charge controller in magenta toner particles is commonly 0.1-10 parts by mass, preferably 0.5-5 parts by mass based on 100 parts by mass of a binder resin.

As a method of incorporating inner additives such as a charge controller into magenta toner particles, there can be listed the same methods as the above ones to incorporate an agent for offset prevention.

<Particle Diameter of Magenta Toner Particles>

The particle diameter of the magenta toner of the present invention is preferably, for example, a volume median diameter of 4-10 μm and more preferably 6-9 μm. This average particle diameter can be controlled by the concentration of a coagulant (a salting-out agent) used, the amount of an organic solvent added, the fusion time, or the composition of a polymer.

When the volume median diameter falls within the above range, transfer efficiency is increased, resulting in enhanced half-tone image quality as well as enhanced thin-line and dot image quality.

The volume median diameter of a magenta toner is measured and calculated using a measurement device of "Coulter Multisizer TA-III" (produced by Beckman Coulter, Inc.) and a data processing computer system (produced by Beckman Coulter, Inc.) connected thereto. Specifically, 0.02 g of the toner is added in 20 ml of a surfactant solution (a surfactant solution prepared, for example, via ten-fold dilution of a neutral detergent containing a surfactant composition with purified water in order to disperse the magenta toner), followed by being wetted and then subjected to ultrasonic dispersion for 1 minute to prepare a magenta toner dispersion. The magenta toner dispersion is injected into a beaker set on the sample stand, containing "ISOTON II" (produced by Beckman Coulter, Inc.), using a pipette until the concentration indicated by the measurement device reaches 8%. This concentration makes it possible to obtain reproducible measurement values. Then, a measured particle count number and an aperture diameter are adjusted to 25000 and 50 μm, respectively, in the measurement device, and a frequency value is calculated by dividing a measurement range of 1-30 μm into 256 parts. The particle diameter at the 50% point from the higher side of the volume accumulation fraction is designated as the volume median diameter.

<External Additive>

The above described magenta toner particles themselves can constitute the magenta toner of the present invention. However, to improve fluidity, chargeability, and cleaning properties, the magenta toner particles may be added with an external additive, for example, a fluidizer which is so-called a post-treatment agent, or a cleaning aid, to form the magenta toner of the present invention.

The post-treatment agent includes, for example, inorganic oxide particles such as silica particles, alumina particles, or titanium oxide particles; stearate particles such as aluminum stearate particles or zinc stearate particles; or inorganic titanate particles such as strontium titanate or zinc titanate. These can be used individually or in combination of at least 2 types.

These inorganic particles are preferably subjected to surface treatment with a silane coupling agent, a titanium coupling agent, a higher fatty acid, or silicone oil to enhance heat-resistant storage stability and environmental stability.

The total added amount of these various external additives is 0.05-5 parts by mass, preferably 0.1-3 parts by mass based on 100 parts by mass of the magenta toner. Further, various appropriate external additives may be used in combination.

[Developer]

The magenta toner of the present invention may be used as a magnetic or non-magnetic single-component toner or a two-component toner by mixing with carriers. When the magenta toner of the present invention is used as a two-component toner, it is possible to use, as a carrier, magnetic particles conventionally known in the art, including metals such as iron, ferrite, or magnetite, as well as alloys of the above metals with metals such as aluminum or lead, but ferrite particles are specifically preferable. Further, it is also possible to use, as the carrier, coated carriers in which the surface of magnetic particles is coated with a coating agent such as a resin; or binder-type carriers composed of magnetic fine powders dispersed in a binder resin.

A coating resin to form the coated carrier is not specifically limited, including, for example, olefin resins, styrene resins, styrene-acryl resins, silicone resins, ester resins, and fluorine resins. Further, as a resin forming the resin-dispersion type carriers, any appropriate resin known in the art can be used without specific limitation, including, for example, styrene-acryl resins, polyester resins, fluorine resins, and phenol resins.

The volume median diameter of the carriers is preferably 20-100 μm, more preferably 20-60 μm. The volume median diameter of the carriers can be determined typically with laser diffraction type particle size distribution meter "HELOS" (produced by Sympatec Co.) equipped with a wet-type homogenizer.

As a preferable carrier, from the viewpoint of anti-spent properties, cited are coated carriers employing a silicone resin, a copolymer (a graft resin) of organopolysiloxane and a vinyl monomer, or a polyester resin as a coating resin. Specifically, from the viewpoint of durability, environmental stability, and anti-spent properties, cited is a carrier coated with a copolymer of organopolysiloxane and a vinyl monomer (a graft resin), the copolymer being further reacted with an isocyanate.

According to such a magenta toner, since the magenta colorant contains a compound represented by Formula (1), and this compound exhibits fluorescence emitting properties, the color gamut thereof becomes almost as wide as that of a display panel in which color production is carried out via an additive color mixing method. Accordingly, it is possible to allow a printed color image to have a color close to that observed on a display panel. Further, since vivid coloration is carried out using the compound represented by Formula (1), a high chroma can be realized, whereby high color reproducibility can be obtained in a wide gamut.

Further, the magenta colorant has a charge controlling function on its own and also exhibits excellent pulverization properties, therefore the magenta colorant is minutely dispersed in toner particles, and sharp charging amount distribution and excellent charge stability can be obtained. Accordingly, the occurrence of toner scattering is prevented even when the humidity varies, and then even in cases of long-term use, contamination of the optical sensors in the machine due to toner scattering is prevented, resulting in no possibility of causing malfunctions or shutdown of the apparatus.

Still further, even when a magenta toner for developing an electrostatic image employing a magenta colorant composed of a compound represented by Formula (1) having at least one sulfo group is produced via an emulsion polymerization aggregation method, no metal chelate is formed with a divalent metal used as a coagulant, whereby no hydrate is confined in the magenta toner particles. Therefore, the water amount is controlled to be lower, resulting in preventing pinhole-like image defects, namely the occurrence of so-called toner blisters generated via water vapor ejection during fixing.

EXAMPLES

Specific examples of the present invention will now be described that by no means limit the scope of the present invention.

In the following examples, a volume median diameter was determined using "MICROTRAC UPA-150" (produced by Honeywell International, Inc.) under such measurement conditions that the sample refractive index was 1.59; the sample specific gravity was 1.05 in terms of a spherical particle; the solvent refractive index was 1.33; and the solvent viscosity was $0.797\times10^{-3}$ Pa·s at 30° C. and $1.002\times10^{-3}$ Pa·s at 20° C. Herein, zero-point adjustment was conducted by placing ion-exchanged water in a measuring cell.

Preparation Example 1 of Colorant Particle Dispersion

There was added 11.5 parts by mass of sodium n-dodecylsulfate into 160 parts by mass of ion-exchanged water, followed by dissolution and stirring to prepare a surfactant aqueous solution. Two parts by mass of a compound represented by above Compound (1-1) was gradually added into this surfactant aqueous solution, followed by dispersion treatment using "CLEAR MIX W MOTION CLM-0.8" (produced by M Technique Co., Ltd.) to prepare a dispersion of colorant particles [1] (colorant particle dispersion [1]) of a volume median diameter of 188 nm.

Preparation Examples 2-8 of Colorant Particle Dispersion

Colorant particle dispersions [2]-[8] containing colorant particles [2]-[8], respectively, were obtained in the same manner as in preparation example 1 of a colorant particle dispersion except that compounds represented by Compound (1-2)-Compound (1-8), respectively, were used instead of Compound (1-1). Each volume median diameter is listed in Table 1.

Preparation Examples 9-24 of Colorant Particle Dispersion

Colorant particle dispersions [9]-[24] containing colorant particles [9]-[24], respectively, were obtained in the same manner as in preparation example 1 of a colorant particle dispersion except that 2 parts by mass of magenta colorants having the compositions shown in column A and column B of Table 1 were used, respectively, instead of 2 parts by mass of Compound (1). Each volume median diameter is listed in Table 1. Herein, in Table 1, "compound [5-1]" is the compound represented by above Compound (5-1); "compound [6-6]" is the compound represented by above Compound (6-6); "non-rhodamine compound [A]" is the compound represented by above Compound (A); "non-rhodamine compound [B]" is the compound represented by above Compound (B); "magenta compound [x]" is the compound represented by following Compound (x); and "magenta compound [y]" is the compound represented by following Compound (y).

[Preparation Example of Binder Resin Particle Dispersion 1]

A separable flask fitted with a stirrer, a thermal sensor, a cooling pipe, and a nitrogen introducing unit was charged with a surfactant solution having been prepared by dissolving 7.08 g of an anionic surfactant (sodium dodecylbenzenesulfonate: SDS) in 2760 g of ion-exchanged water, and while stirring at a stirring rate of 230 rpm under a nitrogen flow, the interior temperature was elevated to 80° C. Meanwhile, 72.0 g of the compound represented by Compound (W) to be

TABLE 1

Compound (x)

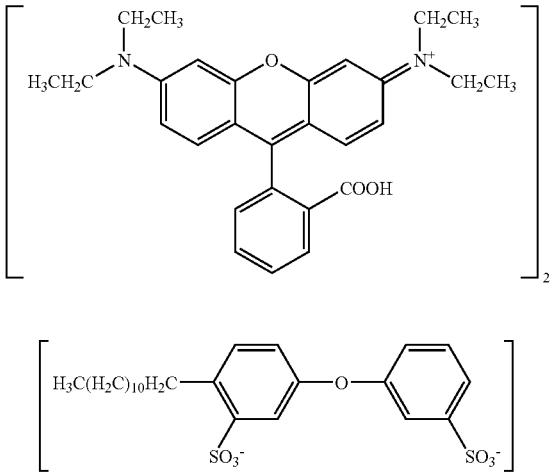

Compound (y)

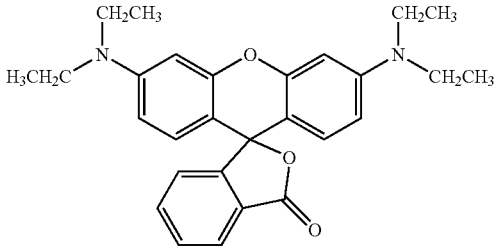

| No. | A | B | mA:mA | Volume-Median Diameter (nm) |
|---|---|---|---|---|
| 1 | Compound (1-1) | — | — | 188 |
| 2 | Compound (1-2) | — | — | 180 |
| 3 | Compound (1-3) | — | — | 190 |
| 4 | Compound (1-4) | — | — | 185 |
| 5 | Compound (1-5) | — | — | 182 |
| 6 | Compound (1-6) | — | — | 182 |
| 7 | Compound (1-7) | — | — | 188 |
| 8 | Compound (1-8) | — | — | 186 |
| 9 | Compound (1-2) | compound [5-1] | 92:8 | 175 |
| 10 | Compound (1-2) | compound [5-1] | 88:12 | 170 |
| 11 | Compound (1-2) | compound [5-1] | 70:30 | 160 |
| 12 | Compound (1-2) | compound [5-1] | 55:45 | 140 |
| 13 | Compound (1-2) | compound [5-1] | 45:55 | 135 |
| 14 | Compound (1-2) | compound [6-6] | 92:8 | 178 |
| 15 | Compound (1-2) | compound [6-6] | 88:12 | 172 |
| 16 | Compound (1-2) | compound [6-6] | 70:30 | 165 |
| 17 | Compound (1-2) | compound [6-6] | 55:45 | 150 |
| 18 | Compound (1-2) | compound [6-6] | 45:55 | 145 |
| 19 | Compound (1-2) | non-rhodamine-based compound [A] | 70:30 | 170 |
| 20 | Compound (1-2) | non-rhodamine-based compound [B] | 70:30 | 170 |
| 21 | magenta compound [x] | — | — | 300 |
| 22 | magenta compound [x] | compound [5-1] | 70:30 | 300 |
| 23 | magenta compound [y] | compound [5-1] | 70:30 | 380 |
| 24 | — | compound [5-1] | — | 135 |

described later, 115.1 g of styrene, 42.0 g of n-butyl acrylate, and 10.9 g of methacrylic acid were mixed, followed by being dissolved by heating to 80° C. to prepare a monomer solution. Then, using a mechanical homogenizer equipped with a circulatory path, the above 2 heated solutions were mixed and dispersed to prepare emulsified particles having a uniform dispersion particle diameter.

Subsequently, there was added a solution having been prepared by dissolving 0.84 g of a polymerization initiator (potassium persulfate: KPS) in 200 g of ion-exchanged water, followed by heating at 80° C. for 3 hours while stirring to prepare resin particles. Thereafter, there was further added a solution having been prepared by dissolving 8.00 g of a polymerization initiator (KPS) and 10.0 g of 2-chloroethanol, as a water-soluble chain transfer agent, in 240 g of ion-exchanged water, and after a lapse of 15 minutes, a liquid mixture (a second monomer solution) of 383.6 g of styrene, 140 g of n-butyl acrylate, and 36.4 g of methacrylic acid was dripped over 120 minutes at 80° C. After dripping, heating was carried out for 60 minutes while stirring, followed by being cooled to 40° C. to give dispersion [LX-1] of binder resin particles.

Compound (*W*): $C\{CH_2OCO(CH_2)_{20}CH_3\}_4$

[Preparation Example of Toner Particle 1]

A 5 l four-neck flask fitted with a thermal sensor, a cooling pipe, a nitrogen introducing unit, and a stirrer was charged with 1250 g of binder resin particle dispersion [LX-1], 2000 g of ion-exchanged water, and 165 g of colorant particle dispersion [1], and then the resulting mixture was stirred. After adjustment to 30° C., a 5 mol/l sodium hydroxide aqueous solution was added to this solution to adjust the pH to 10.0. Subsequently, an aqueous solution, having been prepared by dissolving 52.6 g of magnesium chloride hexahydrate in 72 g of ion-exchange water, was added to the reaction system at 30° C. over 10 minutes while stirring.

Thereafter, after a lapse of a standing time of 3 minutes, temperature elevation was initiated and then the reaction system was heated to a liquid temperature of 90° C. over 6 minutes (temperature elevation rate=10° C./minute). In this state, the particle diameter was determined using "Coulter Counter TA-III" (produced by Beckman Coulter, Inc.). When the volume median diameter reached 6.5 μm, an aqueous solution, having been prepared by dissolving 115 g of sodium chloride in 700 g of ion-exchanged water, was added to terminate particle growth, and heating was continuously conducted at a liquid temperature of 90° C.±2° C. for 6 hours while stirring to carry out fusing. Thereafter, the reaction system was cooled to 30° C. under a condition of 6° C./minute, and then hydrochloric acid was added to adjust the pH to 2.0, followed by terminating stirring. Formed toner particles were isolated via solid-liquid separation and then washing with ion-exchanged water was repeated 4 times (the amount of ion-exchanged water was 15 l), followed by drying with hot air of 40° C. to give toner particle [1].

[Preparation Examples of Toner Particle 2-24]

Toner particle [2]-toner particle [24] were obtained in the same manner as in preparation example of toner particle 1 except that colorant particle dispersion [2]-colorant particle dispersion [24] were used, respectively, instead of colorant particle dispersion [1]. Herein, toner particles [21]-[24] were those to be used for comparison.

[External Additive Treatment of Toner Particle]

Hydrophobic silica (number average primary particle diameter=12 nm; hydrophobization degree=68) was added to each of toner particles [1]-[24] at a ratio of 1% by mass, together with hydrophobic titanium oxide (number average primary particle diameter=20 nm; hydrophobization degree=63) at a ratio of 1% by mass, followed by being mixed using "HENSCHEL MIXER" (produced by Mitsui Miike Engineering Co., Ltd.). Thereafter, coarse particles were removed using a sieve of a 45 μm opening to prepare Toners [1]-[24].

[Preparation of Developer]

Each of Toners [1]-[24] was mixed with a ferrite carrier of a volume average particle diameter of 60 μm coated with a silicone resin so that the concentration of each of the toners is 6% by mass to prepare two-component Developers [1]-[24]. Herein, Developers [1]-[20] are inventive developers and Developers [21]-[24] are comparative developers.

Examples 1-20 and Comparative Examples 1-4

Using Developers [1]-[24], actual machine evaluations with respect to items (1)-(3) described below were conducted employing "bizhub C250" (produced by Konica Minolta Business Technologies, Inc.). The results are listed in Table 2.

(1) Hue Angle and Chroma

A magenta image was formed on art paper "TOKUBISHI ART" (produced by Mitsubishi Paper Mills Limited) with a toner deposited amount of 0.5 mg/cm$^2$. Using spectrophotometer "Gretag Macbeth Spectrolino" (produced by Gretag Macbeth Co.) employing a D65 light source as the light source and a ϕ 4 mm reflection measurement aperture, L*a*b* of each image was measured under the following conditions: a measured wavelength range of 380-700 nm was divided at 10 nm intervals; the viewing angle (for an observer) was set at 2°, and a dedicated white tile was used for reference adjustment. Hue angle H and chroma C* were calculated by following Formula (I) and Formula (II):

Hue angle $(H)=\tan^{-1}(b^*/a^*)$ Formula (I):

Chroma $(C^*)=[(a^*)^2+(b^*)^2]^{1/2}$ Formula (II):

Herein, in Formula (I) and Formula (II), a* and b* each represent the coordinate values in the a* axis-b* axis coordinate plane.

The magenta toner which gives a chroma C* value of 95 or more is evaluated as "Excellent".

The magenta toner which gives a chroma C* value of 90 or more but less than 95 is evaluated as "Good".

The magenta toner which gives a chroma C* value of 85 or more but less than 90 is evaluated as "Acceptable".

The magenta toner which gives a chroma C* value of less than 85 is evaluated as "Unacceptable".

(2) Charge Stability

Under an ambience of high-temperature and high-humidity (30° C. and 85% RH), image forming tests were repeated by forming a magenta image with a toner deposited amount of 0.5 mg/cm$^2$ on 100,000 sheets using art paper "TOKUBISHI ART" (produced by Mitsubishi Paper Mills Limited). When scattered toner powder was visually observed at the bottom of the development device, the number of sheets formed so far was estimated as the limiting sheet number to carry out high quality image forming (also referred to as "limiting sheet number for high quality image").

The charge stability was ranked as "C" when the limiting sheet number for high quality image was less than 500,000.

The charge stability was ranked as "B" when the limiting sheet number for high quality image was 500,000 or more but less than 1,000,000.

The charge stability was ranked as "A" when the limiting sheet number for high quality image was 1,000,000 or more.

(3) Toner Blister Prevention

An image with a magenta toner deposited amount of 0.8 mg/cm$^2$ was formed on a transfer material to visually examine whether or not holes of about 0.1-0.5 mm, namely, toner blisters, were observed in a printed image.

The toner blister prevention was ranked as "A" when no toner blister was formed, namely, the best condition.

The toner blister prevention was ranked as "B" when 1-2 toner blisters per 4 cm$^2$ were formed, but difficult to recognize with the naked eye without gazing.

The toner blister prevention was ranked as "C" when 3 or more toner blisters per 4 cm$^2$ were clearly observed, which was unacceptable for practical use.

TABLE 2

| | Evaluation Result | | | |
|---|---|---|---|---|
| | Chroma | Hue Angle | Charge Stability | Toner Blister Prevention |
| Example 1 | 97 | 337 | B | B |
| Example 2 | 96 | 336 | B | B |
| Example 3 | 98 | 339 | B | B |
| Example 4 | 97 | 340 | B | B |
| Example 5 | 91 | 333 | B | B |
| Example 6 | 95 | 340 | B | B |
| Example 7 | 98 | 337 | B | B |
| Example 8 | 90 | 359 | B | B |
| Example 9 | 91 | 340 | B | B |
| Example 10 | 90 | 341 | A | A |
| Example 11 | 91 | 342 | A | A |
| Example 12 | 87 | 343 | A | A |
| Example 13 | 86 | 344 | A | A |
| Example 14 | 90 | 340 | B | B |
| Example 15 | 91 | 341 | B | B |
| Example 16 | 88 | 342 | A | A |
| Example 17 | 89 | 343 | A | A |
| Example 18 | 86 | 344 | A | A |
| Example 19 | 85 | 342 | A | A |
| Example 20 | 87 | 342 | A | A |
| Comparative Example 1 | 81 | 338 | C | C |
| Comparative Example 2 | 84 | 340 | C | C |
| Comparative Example 3 | 82 | 334 | C | C |
| Comparative Example 4 | 76 | 360 | C | C |

As shown above, it was found that according to Developers [1]-[20] of Examples 1-20, a high chroma and excellent hue angel could be realized as well as enhanced charge stability, and further the occurrence of toner blisters could be prevented, resulting in obtaining images of excellent image quality. Further, it was found that according to a developer further containing a quinacridone compound or a naphthol compound, extremely enhanced charge stability could be realized and also the occurrence of toner blisters could assuredly be prevented.

What is claimed is:

1. A magenta toner for developing an electrostatic image, the magenta toner comprising at least a binder resin and a magenta colorant, wherein the magenta colorant comprises a compound represented by Formula (1):

Formula (1)

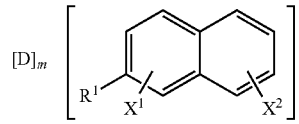

wherein D is represented by Formula (2); $R^1$ represents a hydrogen atom or an alkyl group having 1 to 22 carbon atoms; and $X^1$ and $X^2$ each independently represent a hydrogen atom, an alkyl group or $—SO_3^-$, provided that at least one of $X^1$ and $X^2$ is $—SO_3^-$ and m is an integer representing a number of $—SO_3^-$:

Formula (2)

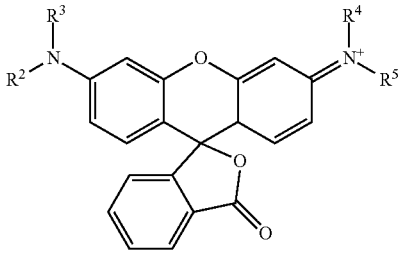

wherein $R^2$ to $R^5$ each represent a hydrogen atom, an alkyl group having 1 to 22 carbon atoms or a cycloalkyl group.

2. The magenta toner of claim 1, wherein the magenta colorant comprises a compound represented by Formula (1) and at least one of a compound represented by Formula (5) and a compound represented by Formula (6); and a ratio of mA:mB is in the range of 90:10 to 55:45, wherein mA represents a mass content of the compound represented by Formula (1); and mB represents a mass content of the at least one of the compound represented by Formula (5) and the compound represented by Formula (6):

Formula (5)

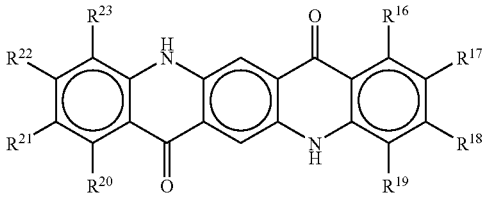

wherein $R^{16}$ to $R^{23}$ each represent a hydrogen atom, a chlorine atom or a methyl group, Formula (6)

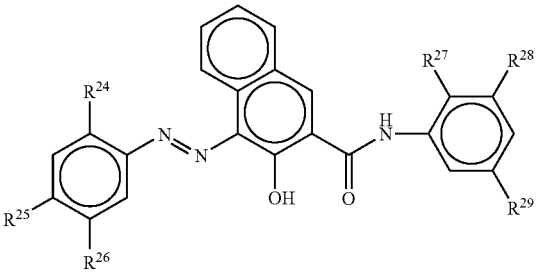

wherein $R^{24}$, $R^{25}$, $R^{27}$, $R^{28}$ and $R^{29}$ each represent a hydrogen atom, a chlorine atom, a methoxy group, a nitro group, a methyl group or $—CONH_2$; and $R^{26}$ represents a hydrogen atom, a chlorine atom, a methoxy group, a nitro group, a methyl group, $—CONHC_6H_5$ or $—SO_2N(CH_2CH_3)_2CONH_2$.

3. The magenta toner of claim 2, wherein the magenta colorant comprises a compound represented by Formula (1) and a compound represented by Formula (5); and a ratio of mA:mB is in the range of 90:10 to 55:45, wherein mA represents a mass content of the compound represented by Formula (1); and mB represents a mass content of the compound represented by Formula (5).

4. The magenta toner of claim 2, wherein the magenta colorant comprises a compound represented by Formula (1) and a compound represented by Formula (6); and a ratio of mA:mB is in the range of 90:10 to 55:45, wherein mA represents a mass content of the compound represented by Formula (1); and mB represents a mass content of the compound represented by Formula (6).

5. The magenta toner of claim 2, wherein the compound represented by Formula (5) is represented by Compound (5-1):

Compound (5-1)

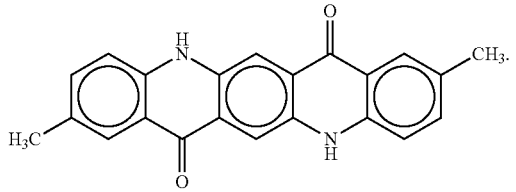

6. The magenta toner of claim 2, wherein the compound represented by Formula (6) is represented by Compound (6-6):

Compound (6-6)

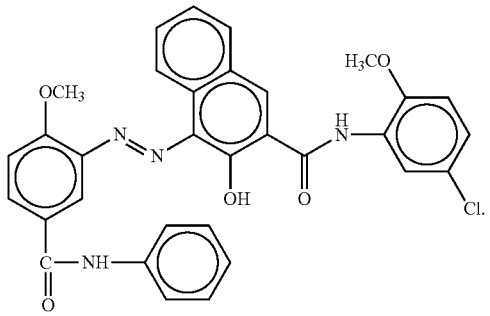

7. The magenta toner of claim 2 comprising both the compound represented by Formula (5) and the compound represented by Formula (6).

8. The magenta toner of claim 1, wherein the compound represented by Formula (1) is represented by Compound (1-1):

Compound (1-1)

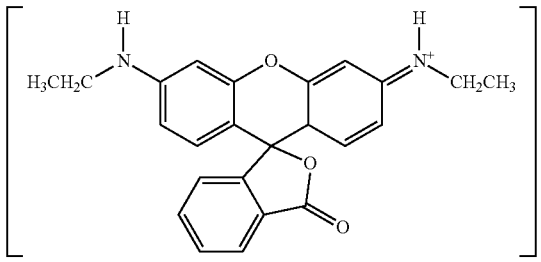

-continued

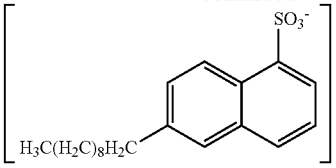

9. The magenta toner of claim 1, wherein the compound represented by Formula (1) is represented by Compound (1-2):

Compound (1-2)

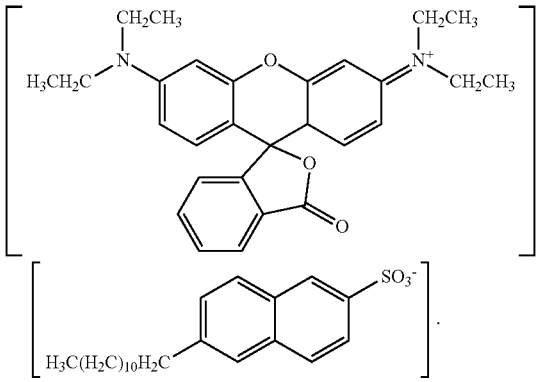

10. The magenta toner of claim 1, wherein, in Formula (1), $R^1$ is an alkyl group having 6 to 18 carbon atoms.

11. The magenta toner of claim 1, wherein, in Formula (1), one of $X^1$ and $X^2$ is $—SO_3^-$ and the other is a hydrogen atom.

12. The magenta toner of claim 1, wherein, in Formula (2), $R^2$ to $R^5$ each represent an ethyl group, a propyl group, a t-butyl group or a cyclohexyl group.

13. The magenta toner of claim 1 exhibiting a hue angle of 325 to 340°.

14. The magenta toner of claim 1 further comprising at least one of a compound represented by Compound (A) and a compound represented by Compound (B):

Compound (A)

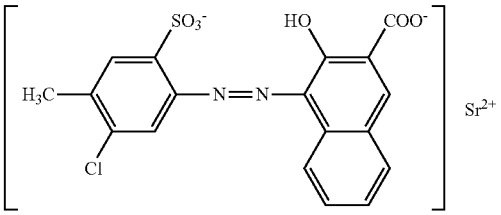

Compound (B)

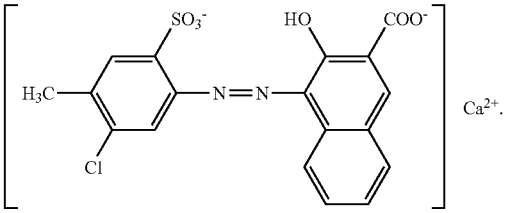

15. The magenta toner of claim 14, wherein a ratio of (a mass content of the compound represented by Formula (1)):(a mass content of the at least one of the compound represented by Compound (A) and the compound represented by Compound (B)) is in the range of 90:10 to 55:45.

* * * * *